United States Patent [19]

Collin

[11] 3,979,791

[45] Sept. 14, 1976

[54] WINDOW HINGES

[75] Inventor: Robert Frederick Dura Collin, Hook Norton, England

[73] Assignee: Alcan Booth Industries Limited, London, England

[22] Filed: July 7, 1975

[21] Appl. No.: 593,378

[30] Foreign Application Priority Data

May 22, 1974 United Kingdom ..... 22967/74

[52] U.S. Cl. ..... 16/135; 16/137; 16/128 R; 16/187; 188/1 R

[51] Int. Cl.[2] ..... E05D 5/06

[58] Field of Search ..... 188/1 R, 187, 180, 71.1, 188/71.4, 71.5; 16/128 R, 137, 135, 136, 170, 187

[56] References Cited

UNITED STATES PATENTS 2,804,641 9/1957 Zavada ..... 16/128 R X

*Primary Examiner*—G. V. Larkin

*Attorney, Agent, or Firm*—Roylance, Abrams, Berdo & Kaul

[57] ABSTRACT

A hinge for windows is provided which enables windows to be pivoted through 180°. The hinge has a common pivot member associated with a friction brake the frictional resistance of which increases after a predetermined initial hinging movement to render operation of the window more manageable.

7 Claims, 4 Drawing Figures

25
B
23
16'
14
54
11
β
19
15
17
18
16
15'
53
8
20
12
α
10

14
23
16'
A
54
25
11
15
19
16
17
15'
20
53
A
10

14
23
16'
54
25
17
53
20
24
15'
12

III
14
23
25
16'
54
27
17
18
19
28
50
51
52
53
12
20
15'
III

WINDOW HINGES

This invention relates to hinges and particularly but not exclusively to reversing hinges for centre-pivot windows having three fulcrum pivots such as described in British Specification No. 1,052,733.

With centre-pivot windows rotatable about a horizontal axis, there is inevitably a degree of imbalance at certain stages of rotation. The imbalance is a maximum when the window is closed and, in the case of a 3-fulcrum pivot reversing hinge, is also great when the window is fully reversed (rotated through 180°).

It is desirable to brake the hinges or pivots, particularly in the case of a large window, so as to make the operation of the window more manageable. As the imbalance is a maximum when the window is closed, a brake with a constant torque could make the window more difficult to open.

The invention has for an object to provide a hinge for windows of the kind above referred to which incorporates a two-stage friction brake, the full frictional resistance of which is delayed until the window has been rotated through several degrees from the closed position.

Preferably the brake comprises a multi-plate friction brake having at least three friction pads, the mechanism being so arranged that a part (preferably a minor part) of the friction surface of the brake is always active, while the remaining part (preferably the major part) of the friction surface only comes into action when the window has been rotated through several degrees, for example 15°, as desired.

Accordingly the invention consists in a hinge for windows which pivot about a horizontal axis comprising two hinge members interconnected by a common pivot wherein the common pivot is associated with a friction brake the frictional resistance of which to pivotal movement of the hinge members increases after an initial relative movement of the hinge members about the common pivot.

In order that the invention may be more clearly understood, reference will now be made to the accompanying drawing, in which.

Figure 4:
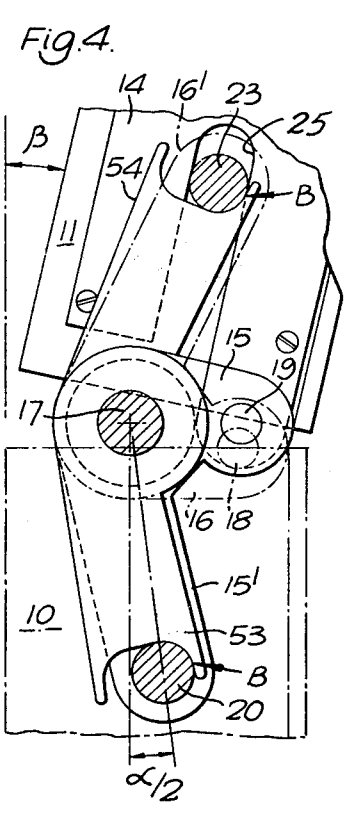
FIG. 4 is a section similar to that of FIG. 3 but with the window in the partially open position.

The hinge shown is generally of the construction shown in Specification No. 1,052,733 and the same reference numerals are used herein for corresponding parts of the hinge. As shown, the hinge includes two hinge members provided by two bell-crank levers 15, 15′, 16, 16′, pivotted at their apices about a common pivot 17 and of which the arms 15, 16 respectively carry pins 19 and 18 pivotted in the plate members 12, 14 secured to the frame 10 and the sash 11 respectively of a window. The other arms 15′, 16′ carry pins 20, 23 respectively which are arranged to slide in slots 24, 25 in the plates 12 and 14 to ensure symmetrical movement of the levers about the common pivot during hinging.

Figure 3:
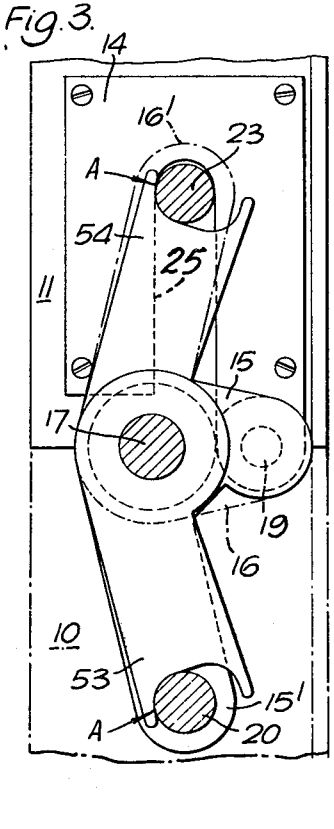
FIG. 3 is a section on line III—III of FIG. 1 with the window in the closed position.

Clamped between the two double-armed levers by their common pivot pin 17 is a friction brake comprising three layers or pads of friction material 50,51 and 52 between which are interposed brake leaves 53,54 having arms of which the ends are forked or slotted (see FIGS. 2 and 3) to embrace the pins, 20,23 respectively. The mounting of the brake pads 50, 52 and 52 includes a pair of washers 27, 28. Either or both of these washers 27, 28 may be spring washers and furthermore one or more additional friction pads may be mounted between these washers and the levers. The spacing between the opposing fingers of the forks at the ends of the arms of the brake leaves 53 and 54 is greater than the diameter of the pins 20 and 23 so that when the window is opened there is a lost motion before the brake leaves are moved. Thus the frictional resistance of the friction brake increases after an initial relative movement of the levers about the common pivot 17.

Figure 2:
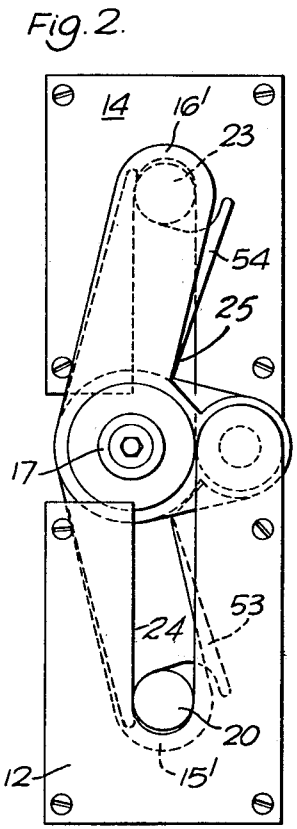
FIG. 2 is a side view of the hinge of FIG. 1.
Figure 1:
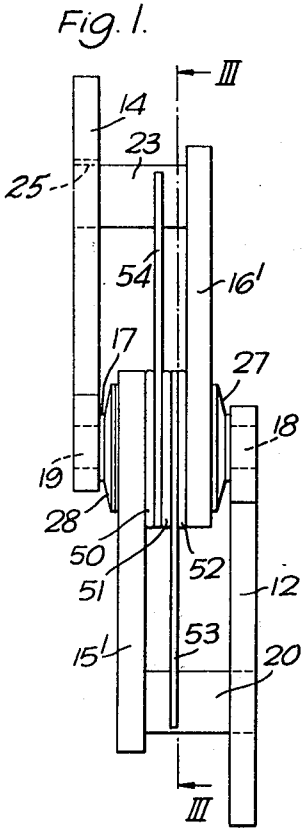
FIG. 1 is a fragmentary side view of a hinge as described in Specification No. 1,052,733 incorporating the braking arrangement according to this invention.

FIG. 2 shows the arrangement when the window is shut. It will be seen that the forks of the brake leaves 53,54 are in contact with the pins 20 and 23 at the points A. When the window is partly opened through a small angle $\beta$ before the major braking resistance comes into action (see FIG. 3), the brake leaves are still in the same relative position as when the window was closed, but their forked ends now contact the pins 20 and 23 at the points B. During this rotation through the angle $\beta$ only the two outermost surfaces of the pads 50,52 which are in frictional engagement with the levers have a braking effect Further rotation brings all layers into action as the brake leaves 53,54 move with their associated levers.

When the rotation of the window is reversed, the lever arms must rotate initially through the angle $\alpha$ before the full friction action is developed in the reverse direction.

Whilst a particular embodiment has been described, it will be understood that various modifications may be made without departing from the scope of the invention. For example, while pins 20,23 form convenient stops for the brake leaves, other stops could be employed.

I claim:

1. A hinge for windows comprising:

a. first and second hinge members, b. a common pivot member hingedly converting said first and second hinge members, c. friction brake means associated with said common pivot member, and d. means operative to increase the frictional resistance of the friction brake means to pivotal movement of said first and second hinge members after an initial relative movement of said hinge members about said common pivot member, said friction brake means comprising:

a plurality of friction brake pads coaxially mounted on said common pivot member between said first and second hinge members and in operative frictional engagement therewith;

at least one brake leaf positioned between two of said brake pads and pivotable about said common pivot member, and means coupling said brake leaf to one of said first and second hinge members with a lost-motion connection permitting initial pivotal movement of said one hinge member before it moves said brake leaf coupled thereto about said common pivot member.

2. A hinge as claimed in claim 1, wherein said friction brake means comprises:

a. at least three brake pads, the outer brake pads being in frictional engagement with said first and second hinge members respectively, b. first and second brake leaves disposed between different pairs of said brake pads, and c. first and second coupling means coupling said first and second brake leaves to said first and second hinge members respectively each with a lost-motion connection permitting initial pivotal movement of said hinge members before said brake leaves respectively coupled thereto are moved about said common pivot member.

3. A hinge as clamed in claim 1, wherein said first and second hinge members are bell-crank levers each having first and second arms, and said common pivot member hingedly connects said first and second levers at their apices, said hinge including a. means for separately pivotally connecting the respective first arms of said levers to the frame and sash of a window respectively, and b. means for guiding the respective second arms of said lever operative to effect symmetrical movement of said first and second levers about said common pivot member during hinging.

4. A hinge as claimed in claim 3, wherein said friction brake means comprises:

a. a plurality of friction brake pads coaxially mounted on said common pivot member between said first and second levers and in operative frictional engagement therewith;

b. at least one brake leaf positioned between two of said brake pads and pivotable about said common pivot member, and c. means coupling said brake leaf to one of said first and second levers with a lost-motion connection permitting initial pivotal movement of said one lever before it moves said brake leaf coupled thereto about said common pivot member.

5. A hinge as claimed in claim 4, wherein said friction brake means comprises:

a. at least three brake pads, the outer brake pads being in frictional engagement with said first and second levers respectively, b. first and second brake leaves disposed between different pairs of said brake pads, and c. first and second coupling means coupling said first and second brake leaves to said first and second levers respectively each with a lost-motion connection permitting initial pivotal movement of said hinge members fore said brake leaves respectively coupled thereto are moved about said common pivot member.

6. A hinge as claimed in claim 5, wherein said first and second coupling means each comprise a pin provided on each said second arm of said first and second levers, said first and second brake leaves are each provided with spaced portions located at opposite sides of the pin associated therewith and spaced apart by a distance greater than the size of the pin.

7. The hinge of claim 6, and comprising:

a. first and second members to which said first arms of said first and second levers are respectively pivotally connected, and b. a guide slot defined in each of said first and second members, each pin moving in the guide slot in the member to which the other lever is pivotally connected to provide said means for guiding said second arms of said first and second levers.

* * * * *